US006210849B1

(12) United States Patent
Fukuda et al.

(10) Patent No.: US 6,210,849 B1
(45) Date of Patent: Apr. 3, 2001

(54) COLOR TONER, AND IMAGE FORMING APPARATUS AND TONER CARTRIDGE USING SAID TONER

(75) Inventors: Makoto Fukuda; Norio Sawatari, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/650,768

(22) Filed: Aug. 29, 2000

(30) Foreign Application Priority Data

Sep. 21, 1999 (JP) ..... 11-267566

(51) Int. Cl.[7] ..... G03G 9/09; G03G 9/097; G03G 15/20

(52) U.S. Cl. ..... 430/106; 430/110; 399/336

(58) Field of Search ..... 430/106, 110; 399/336

(56) References Cited

U.S. PATENT DOCUMENTS 4,411,974 * 10/1983 Lu et al. ..... 430/110
4,411,975 * 10/1983 Lu et al. ..... 430/110
6,132,916 * 10/2000 Ueda et al. ..... 430/106

FOREIGN PATENT DOCUMENTS 7-191492 7/1995 (JP) .

* cited by examiner

*Primary Examiner*—Roland Martin
(74) *Attorney, Agent, or Firm*—Armstrong, Westerman, Hattori, McLeland & Naughton LLP

(57) ABSTRACT

A color toner used in a color image forming apparatus that fixes a toner image onto a recording medium by flashlight is provided. A toner image formed from this color toner can be fixed by smaller light energy. This color toner includes binder resin, infrared ray absorption agent, colorant, and a compound expressed by a formula:

(1)

wherein R represents an alkyl group having 4 to 200 carbon atoms.

5 Claims, 3 Drawing Sheets

COLOR TONER, AND IMAGE FORMING APPARATUS AND TONER CARTRIDGE USING SAID TONER

BACKGROUND OF THE INVENTION

1. Field of the Invention

The present invention generally relates to color toners used in electrophotography, and, more particularly, to a color toner that is fixed onto a recording medium by means of the optical energy of flashlight.

2. Description of the Related Art

Electrophotography is a technique widely used in image forming apparatuses such as copying machines, electrophotographic facsimile machines, and electrophotographic printers. As disclosed in U.S. Pat. No. 2,297,691, an electrophotographic technique using photoconductive insulating body has been widely used. According to this technique, an electrostatic latent image is formed by emitting light, such as laser or LED, onto a photoconductive insulating body charged by corona discharges or a charge supply roller. Resin particles called toner that is colored with pigments or dyes are electrostatically fixed to the electrostatic latent image to obtain a toner image. This toner image is then transferred onto a recording medium such as paper or film. At this point, the toner image is only placed on the recording medium, and, therefore, needs to be fixed to the recording medium. Accordingly, the toner is melted on the recording medium by heat, pressure, or light, and are then solidified. Thus, a toner image fixed onto the recording medium can be obtained.

As described above, the toner fixing is carried out by melting toner mainly made up of thermoplastic resin (hereinafter referred to as "binder resin") and then fixing the melted toner onto the recording medium. Well-known examples of such toner fixing methods include a heat-roll technique in which a recording medium having a toner image formed thereon is heated and pressurized directly by a roller, and a flash fixing technique in which toner is fixed onto a recording medium by flashlight from a xenon flash lamp, for instance.

According to the flash fixing technique, toner is melted and fixed onto a recording medium by converting light energy originated from flashlight of a discharge tube of a xenon flash lamp into thermal energy.

This flash fixing technique has advantages over the heat-roll technique in an image forming apparatus. The advantages include: (1) the resolution of the toner image formed on a photoconductive insulating film does not deteriorate by the non-contact fixing; (2) no warm-up time is necessary for the image forming apparatus, and an image forming operation can be promptly started; and (3) the fixing can be carried out on recording media of any material or thickness, such as adhesive paper, pre-printed paper, and paper having various thicknesses.

The process of fixing toner onto a recording medium by flashlight are as follows. Flashlight emitted from a discharge tube is absorbed by a toner image (particle image) formed on the recording medium, and is then converted into thermal energy. The toner is heated up accordingly, and is melted. As a result, the toner adheres to the recording medium. After the flashlight emission, the temperature drops, and the melted toner solidifies to form a fixed toner image.

In the spectral distribution of the xenon flash lamp widely used as a discharge tube for flash fixing, the light emission strength is very high in the near-infrared wavelength region of 800 nm to 1100 nm, and is relatively low in the visible region of 400 nm to 800 nm. Accordingly, toner for flash fixing needs to have high light absorptivity with respect to light in the near-infrared wavelength region.

However, binder resin that is the main component of toner generally has very low light absorptivity in the visible region and the near-infrared region.

When the colorant is black, toner has high light absorptivity in the visible region and the near-infrared region. When the colorant is a coloring material, such as yellow, cyan, magenta, red, blue, or green, toner has acceptable light absorptivity in the visible region, but has only low light absorptivity in the near-infrared region. As a result, it is difficult to fix the color toner containing the binder resin and the coloring material by flashlight only strong enough to fix black toner. Accordingly, the fixing of the color toner requires strong light energy.

To fix color toner onto a recording medium by flashlight, there have been techniques of adding infrared ray absorption agent in the near-infrared wavelength region, which is the light emission wavelength region of a xenon flash lamp, thereby reducing the use of light energy. For instance, Japanese Laid-Open Patent Application Nos. 61-132959, 6-118694, and 7-191492 each disclose a technique in which an aminium compound or a imonium compound is added to toner for flash fixing. In Japanese Laid-Open Patent Application No. 6-238056, resin particles including infrared ray absorption agent containing anthraquinone dye, polymethine dye, or cyanine dye, are attached to the surfaces of toner particles. Also, in Japanese Laid-Open Patent Application No. 10-39535, tin oxide or indium oxide is added to toner so as to increase the fixity of color toner by flashlight.

In the above disclosed techniques, infrared ray absorption agent is added to color toner, so as to promote the conversion efficiency of converting light energy into thermal energy, and to increase the meltability of the binder resin.

However, the addition of the infrared ray absorption agent is not enough the melt the binder resin. Also, the aminium compound and the imonium compound used as the preferred infrared ray absorption agent is colored, and a large amount of those compounds will have adverse influence on a fixed color image. Accordingly, it is preferable to use a small amount of infrared ray absorption agent.

As described so far, a greater amount of light energy is required for fixing color toner by flashlight.

SUMMARY OF THE INVENTION

A general object of the present invention is to provide color toner for flash fixing in which the above disadvantages are eliminated.

A more specific object of the present invention is to provide color toner suitable for flash fixing that reduce the use of light energy and enable excellent image formation, and to an image forming apparatus utilizing the color toner.

The above objects of the present invention are achieved by a color toner to be fixed onto a recording medium by flashlight, comprising binder resin, infrared ray absorption agent, colorant, and a compound expressed by a formula:

(1)

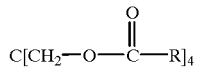

wherein R represents an alkyl group having 4 to 200 carbon atoms.

The compound expressed by the formula (1) melts even when the thermal energy converted from the light energy of flashlight is relatively small. Accordingly, the compound expressed by the formula (1) functions as an auxiliary binder, so that the color toner can be securely fixed onto a recording medium. Thus, reliable color toner fixing can be performed with less light energy than in the prior art.

The above objects of the present invention are also achieved by an image forming apparatus or a toner cartridge in which the above color toner is used.

The above and other objects and features of the present invention will become more apparent from the following description taken in conjunction with the accompanying drawings.

DESCRIPTION OF THE PREFERRED EMBODIMENTS

Figure 1:
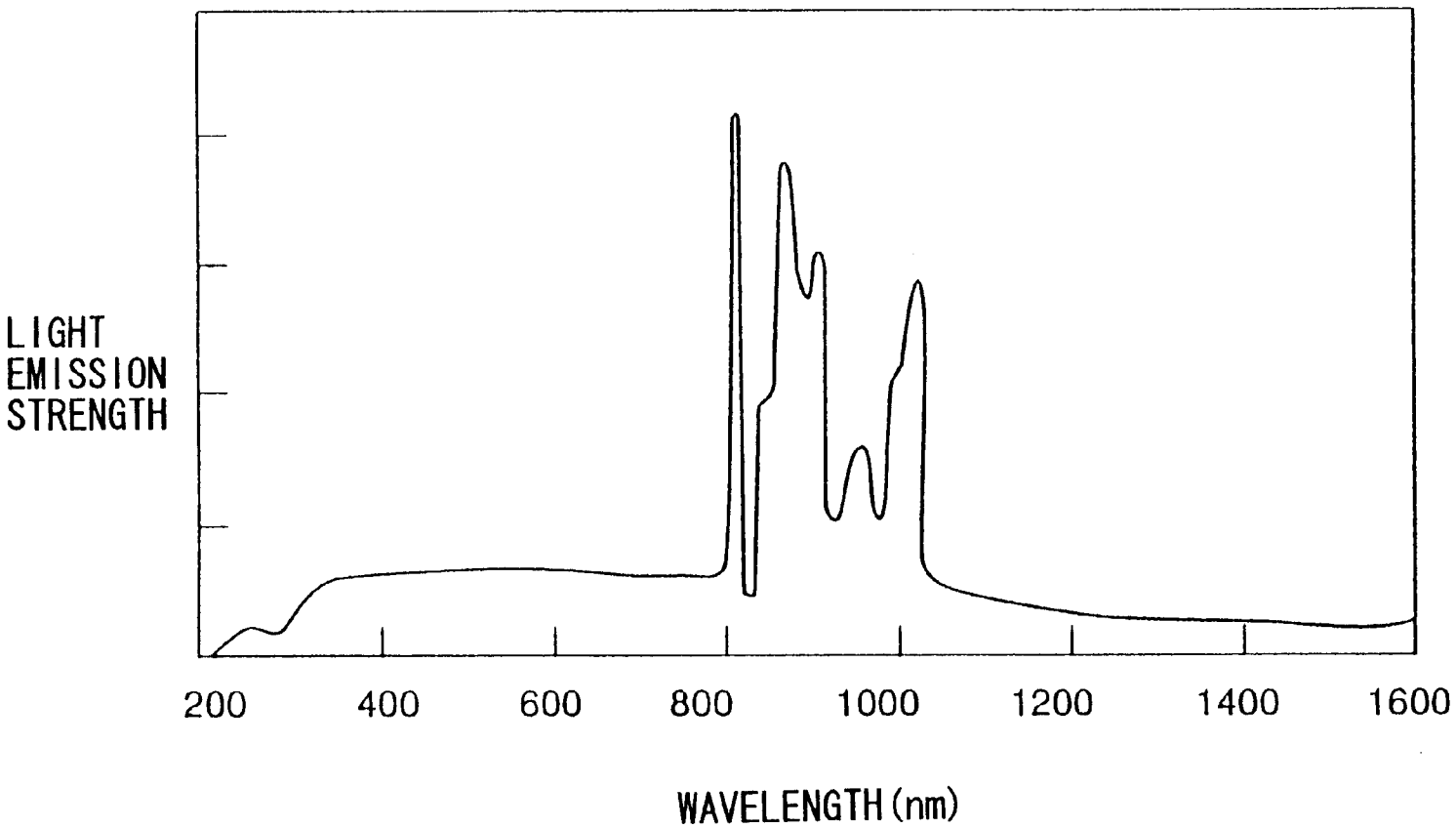
FIG. 1 shows the spectral distribution of a xenon flash lamp generally used.

The following is a description of embodiments of the present invention, with reference to the accompanying drawings.

A color toner suitable for flash fixing comprises binder resin, infrared ray absorption agent, colorant, and a component expressed by the general formula (1). This color toner can be used in conventional electrophotographic image forming apparatuses such as copying machines, printers, and facsimile machines.

The infrared ray absorption agent has a function of converting light energy of flashlight into thermal energy in the fixing unit of an image forming apparatus. The infrared ray absorption agent is originally added to the toner to facilitate the meltdown of the binder resin.

In the color toner of the present invention, however, the component expressed as the general formula (1) melts itself using the terminal energy converted by the infrared ray absorption agent, and serves as an auxiliary binder to ensure that the color toner is fixed to a recording medium. Hereinafter, the compound expressed by the general formula (1) will be referred to as "the auxiliary binder".

Since the auxiliary binder melts by means of the thermal energy converted by the infrared ray absorption agent, a low-molecular weight alkyl group having a low melting point is preferable. However, if the molecular weight is too low, the carrier surface is contaminated by a two-component developer, or the developing roller surface and the film restricting blade surface is contaminated by a one-component developer when printing is performed on a great number of sheets. On the other hand, if the molecular weight is too high, the melting point becomes high accordingly, resulting in poor fixity with low energy. In view of these facts, the auxiliary binder expressed by the general formula (1) preferably has a melting point of 60° C. to 100° C., or more preferably, 75° C. to 90° C. Meanwhile, the melting point of a resin generally used as a binder is measured at 80° C. to 140° C. Accordingly, the auxiliary binder contained in the color toner of the present invention melts even when the meltdown of the binder resin is not sufficient due to a decrease of the thermal energy obtained from flashlight. Thus, the color toner of the present invention can be securely fixed to a recording medium.

Various types of thermoplastic resin can be used for the binder resin contained in the color toner of the present invention. For instance, one or a combination of resins having a glass transition point of 40° C. to 80° C. and a softening point of 80° C. to 140° C., such as epoxy resin, styrene-acrylic resin, polyamide resin, polyester resin, polyvinyl resin, polyurethane resin, and polybutadiene resin, can be used as the binder resin contained in the color toner of the present invention. If necessary, wax, such as carnauba wax, montan wax, polyethylene, amides, or polypropylene, may be added to the binder resin.

The infrared ray absorption agent is preferably made up of at least one of an aminium compound, a imonium compound, or a naphthalocyanine compound, because these compounds effectively convert light energy originated from flashlight into thermal energy.

The aminium compound is expressed by a formula (2):

(2)

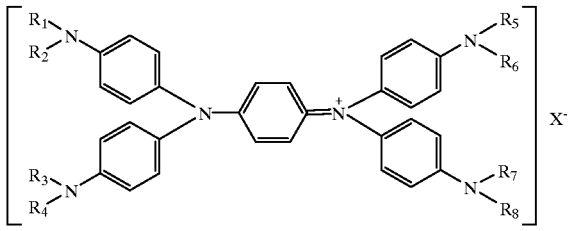

wherein $R_1$ to $R_8$ each represent a hydrogen atom, a halogen atom, an alkyl group, an aryl group, an alkoxyl group, a nitro group, or a carboxyl group, and $X^-$ represents an anion.

The imonium compound is expressed by a formula (3):

(3)

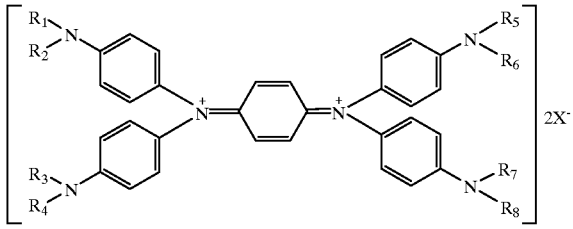

wherein $R_1$ to $R_8$ each represent a hydrogen atom, a halogen atom, an alkyl group, an aryl group, an alkoxyl group, a nitro group, or a carboxyl group, and $X^-$ represents an anion.

The naphthalocyanine compound is expressed by a formula (4):

(4)

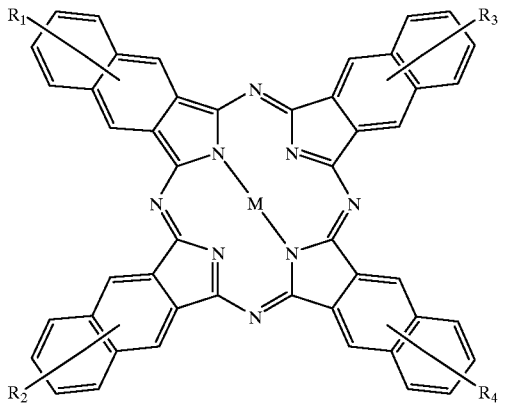

wherein M represents a metal, a metal oxide, or a halogen metal, and $R_1$ to $R_4$ each represent a hydrogen atom, a halogen atom, an alkyl group, an aryl group, an alkoxyl group, a nitro group, or a carboxyl group.

Here, the anion $X^-$ may be $ClO_4^-$, $SbF_6^-$, $AsF_6^-$, $BF_4^-$, or $Mo_8O_{26}^{4-}$.

The infrared ray absorption agent may be a combination of two or more different kinds of infrared ray absorption agent. Further, a metal complex compound, such as a phthalocyanine compound, an anthraquinone compound, a polymethine compound, or a nickel complex, may be added to the infrared ray absorption agent. The proportion of the infrared ray absorption agent is preferably 0.1 to 10 parts by weight, or more preferably, 0.1 to 3 parts by weight, per 100 parts by weight of the toner. As described before, if the amount of infrared ray absorption agent is too great, the hue of a fixed toner image greatly changes from the original hue of the pigment, resulting in poor saturation of the image. To avoid such a problem, the color toner of the present invention aims to restrict the infrared ray absorption agent to a smaller amount than in the prior art.

The colorant contained in the color toner is not particularly limited, and any known colorant can be used. For instance, a monoazo red pigment, a disazo yellow pigment, a quinacridone magenta pigment, an anthraquinone dye, a nigrosine dye, a quaternary ammonium salt, or a metal complex salt dye containing can be used as the colorant in the color toner of the present invention. Any combination of those pigments and dyes can also be used.

More specifically, examples of the colorant contained in the color toner of the present invention include Aniline Blue (C.I. No. 50405), Chalco Oil Blue (C.I. Azoic Blue 3), Chrome Yellow (C.I. No. 14090), Ultra Marine Blue (C.I. No. 77103), DuPont Oil Red (C.I. No. 26105), Quinoline Yellow (C.I. No. 47005), Methylene Blue Chloride (C.I. NO. 52015), Phthalocyanine Blue (C.I. No. 74160), Malachite Green Oxalate (C.I. No. 42000), Food Red 2 (Amaranth, C.I. No. 16185), Food Red 3 (Erythrosine, C.I. No. 45430), Food Red 40 (Allura Red AC, C.I. No. 16035), Food Red 102 (New Coccine, C.I. NO. 16255), Food Red 104 (Phloxine, C.I. NO. 45410), Food Red 105 (Rose Bengal, C.I. NO. 45440), Food Red 106 (Acid Red, C.I. No. 45100), Food Yellow 4 (Tartrazine, C.I. No. 19140), Food Yellow 5 (Sunset Yellow FCF, C.I. No. 15985), Food Green 3 (Fast Green FCF, C.I. No. 42053), Food Blue 1 (Brilliant Blue FCF, C.I. No. 42090), and Food Blue 2 (Indigo Carmine, C.I. No. 73015).

The proportion of the amount of the colorant contained in the color toner of the present invention is normally 0.1 to 20 part by weight, or more preferably, 0.5 to 10 parts by weight, per 100 parts by weight of the color toner.

As described above, the color toner of the present invention contains 75 to 95 parts by weight of binder resin, 0.1 to 20 parts by weight or more preferably 0.5 to 10 parts by weight of colorant, 0.1 to 10 parts by weight or more preferably 0.1 to 3 parts by weight of infrared ray absorption agent, and 0.1 to 5 parts by weight of auxiliary binder, per 100 parts by weight of the color toner.

Further, charge control agent can be added to the color toner of the present invention, so that a charge amount variation is small under various circumstances. This charge control agent is preferably colorless or pale-colored. Known positive or negative charge control agent, such as a quaternary ammonium salt compound, a salicylic acid compound, a boron complex, or a carboxylic acid compound, can be used for the charge control agent.

The color toner of the present invention can be manufactured by a conventional method. First, the binder resin, the infrared ray absorption agent, the colorant, and the compound expressed by the general formula (1) are prepared, and the charge control agent and wax are added to the resultant, if necessary, to obtain the raw material. This raw material is then kneaded by a pressure kneader, a roll mill, or an extruder, and is uniformly dispersed. The dispersed raw material is ground and pulverized by a grinder or a jet mill, and is then classified by a pneumatic classifier to obtain a color toner having a desired particle size distribution.

As disclosed in Japanese Laid-Open Patent Application No. 7-191492, after the infrared ray absorption agent and the charge control agent are each kneaded with a resin independently of each other, the two agents may be kneaded together.

To increase the fluidity of the color toner of the present invention, inorganic particles (hereinafter referred to as "external additive") may cover the surfaces of the toner articles. The external additive used here is constituted by particles each having a particle size of 5 nm to 2 $\mu$m, or more preferably, 5 nm to 500 nm. The BET specific surface area of the external additive particles is preferably 20 $m^2/g$ to 500 $m^2/g$. The proportion of the external additive to be added to the color toner of the present invention is 0.1 to 5 parts by weight, or more preferably, 0.1 to 2 parts by weight, per 100 parts by weight of the toner. Examples of the external additive particles to be added to the color toner of the present invention include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Among these examples, it is particularly preferable to use silica fine particles. The external additive particles are preferably hydrophobic.

EXAMPLES

Preparation of Color Toner

Blue-color toners described below in Examples 1 to 3 were prepared as the color toner of the present invention. The compound expressed by the formula (1) (Nissan Electol, WEP-5: manufactured by NOF Corporation) was used as the auxiliary binder.

For comparison, blue-color toners containing no auxiliary binder were also prepared as Comparative Examples 1 to 3.

The details of the components of Examples 1 to 3 and Comparative Examples 1 to 3 are as follows.

Example 1

| | |
|---|---|
| Binder resin: polyester resin (NCP-001J: manufactured by Nippon Carbide Industries, Co., Inc.) | 91 parts by weight |
| Infrared ray absorption agent: aminium salt compound (NIR-AM1: manufactured by Teikoku Chemical Industries, Co., Ltd.) | 2 parts by weight |
| Colorant: copper phthalocyanine pigment (Lionol Blue ES: manufactured by Toyo Ink Mfg. CO., Ltd.) | 5 parts by weight |
| Auxiliary binder: the compound (1) (WEP-5: manufactured by NOF Corp.) | 2 parts by weight |

The above components were put into a Henschel mixer, and were pre-mixed. The pre-mixed resultant was kneaded by an extruder, and was roughly ground by a hammer mill, followed by fine grinding by a jet mill. The resultant was classified by an air classifier to obtain a blue-color toner having a volume mean particle size of about 8.5 $\mu$m. As the external additive, 0.5 parts by weight of hydrophobic silica fine particles (HVK2150: manufactured by Clariant K.K.) were added to the blue-color toner, and an external addition process was carried out by a Henschel mixer so as to cover the surfaces of the blue-color toner particles with the external additive.

Example 2

A blue-color toner was prepared in the same manner as in Example 1, except that the following components were employed.

| | |
|---|---|
| Binder resin: polyester resin (NCP-001J: manufactured by Nippon Carbide Industries, Co., Inc.) | 92 parts by weight |
| Infrared ray absorption agent: diimonium salt compound (NIR-IM1: manufactured by Teikoku Chemical Industries, Co., Ltd.) | 1 part by weight |
| Colorant: copper phthalocyanine pigment (Lionol Blue ES: manufactured by Toyo Ink Mfg. Co., Ltd.) | 5 parts by weight |
| Auxiliary binder: the compound (1) (WEP-5: manufactured by NOF Corp.) | 2 parts by weight |

Example 3

A blue-color color was prepared in the same manner as in Example 1, except that the following components were employed.

| | |
|---|---|
| Binder resin: polyester resin (NCP-001J: manufactured by Nippon Carbide Industries, Co., Inc.) | 90 parts by weight |
| Infrared ray absorption agent: naphthalocyanine compound (YKR-5010: manufactured by Yamamoto Kasei K.K.) | 3 parts by weight |
| Colorant: copper phthalocyanine pigment (Lionol Blue ES: manufactured by Toyo Ink Mfg. Co., Ltd.) | 5 parts by weight |
| Auxiliary binder: the compound (1) (WEP-5: manufactured by NOF corp.) | 2 parts by weight |

Comparative Example 1

A blue-color toner was prepared in the same manner as in Example 1, except that no auxiliary binder was employed.

| | |
|---|---|
| Binder resin: polyester resin (NCP-001J: manufactured by Nippon Carbide Industries, Co., Inc.) | 93 parts by weight |
| Infrared ray absorption agent: aminium salt compound (NIR-AM1: manufactured by Teikoku Chemical Industries, Co., Ltd.) | 2 parts by weight |
| Colorant: copper phthalocyanine pigment (Lionol Blue ES: manufactured by Toyo Ink Mfg. Co., Ltd.) | 5 parts by weight |

Comparative Example 2

A blue-color toner was prepared in the same manner as in Example 1, except that no auxiliary binder was employed.

| | |
|---|---|
| Binder resin: polyester resin (NCP-001J: manufactured by Nippon Carbide Industries, Co., Inc.) | 94 parts by weight |
| Infrared ray absorption agent: diimonium salt compound (NIR-AM1: manufactured by Teikoku Chemical Industries, Co., Ltd.) | 1 part by weight |
| Colorant: copper phthalocyanine pigment (Lionol Blue ES: manufactured by Toyo Ink Mfg. Co., Ltd.) | 5 parts by weight |

Comparative Example 3

A blue-color toner was prepared in the same manner as in Example 1, except that no auxiliary binder was employed.

| | |
|---|---|
| Binder resin: polyester resin (NCP-001J: manufactured by Nippon Carbide Industries, Co., Inc.) | 92 parts by weight |
| Infrared ray absorption agent: naphthalocyanine compound (YKR-5010: manufactured by Yamamoto Chemicals, Inc.) | 3 parts by weight |
| Colorant: copper phthalocyanine pigment (Lionol Blue ES: manufactured by Toyo Ink Mfg. Co., Ltd.) | 5 parts by weight |

Test and Evaluation on Color Toner Fixity

A toner image formed by each of the color toner of Examples 1 to 3 and Comparative Examples 1 to 3 was produced on a recording medium by a flash fixing printer that used a two-component developer, and the fixity of each toner image was evaluated.

The two-component developer used in this test contains 4.5 parts by weight of one of the blue toners and 95.5 parts by weight of Resin-Coated Magnetite Carrier (GF-320: manufactured by Kanto Denka Kogyo, Co., Ltd.), which were mixed by a ball mill.

A laser printer (F6760D: manufactured by Fujitsu Ltd.) that employs the xenon lamp fixing technique was used. The bias potential to be applied to the flash lamp was changed, so that the amount of light energy can vary in each unit area on a recording medium (paper). The particle image of each color toner of Examples 1 to 3 and Comparative Examples 1 to 3 was melted and then solidified to obtain a fixed image under the various light energy conditions. The fixity of each fixed image was evaluated.

The evaluation was made through a tape removing test. The procedures of this test are as follows. First, adhesive tape (Scotch Mending Tape: manufactured by 3M Corp.) is attached to each fixed image, and a cylindrical block is rolled on the fixed image in the circumferential direction so that the tape is bonded to the surface of the image at a linear pressure of 250 g/cm. The tape is then removed from the image, and the optical density ratio of the image after the tape removal to the image before the tape removal, which is expressed by the equation below, is used as the fixing rate in the evaluation.

$$\text{fixing rate (\%)} = \frac{\text{optical density of fixed image after tape removal}}{\text{optical density of fixed image}} \times 100$$

The optical density of each fixed image is the absorbancy value of the greatest wavelength obtained by measuring the reflection light in the wavelength range of 400 nm to 800 nm by a spectrophotometer (CM-3700d: manufactured by Minolta Co., Ltd.).

As the amount of toner varies on the recording sheet, the fixing rate also varies. Therefore, the fixing rate (%) of each toner fixed image having the toner amount of 0.70±0.05 g/cm$^2$ on the recording sheet was measured in this evaluation.

Figure 2:
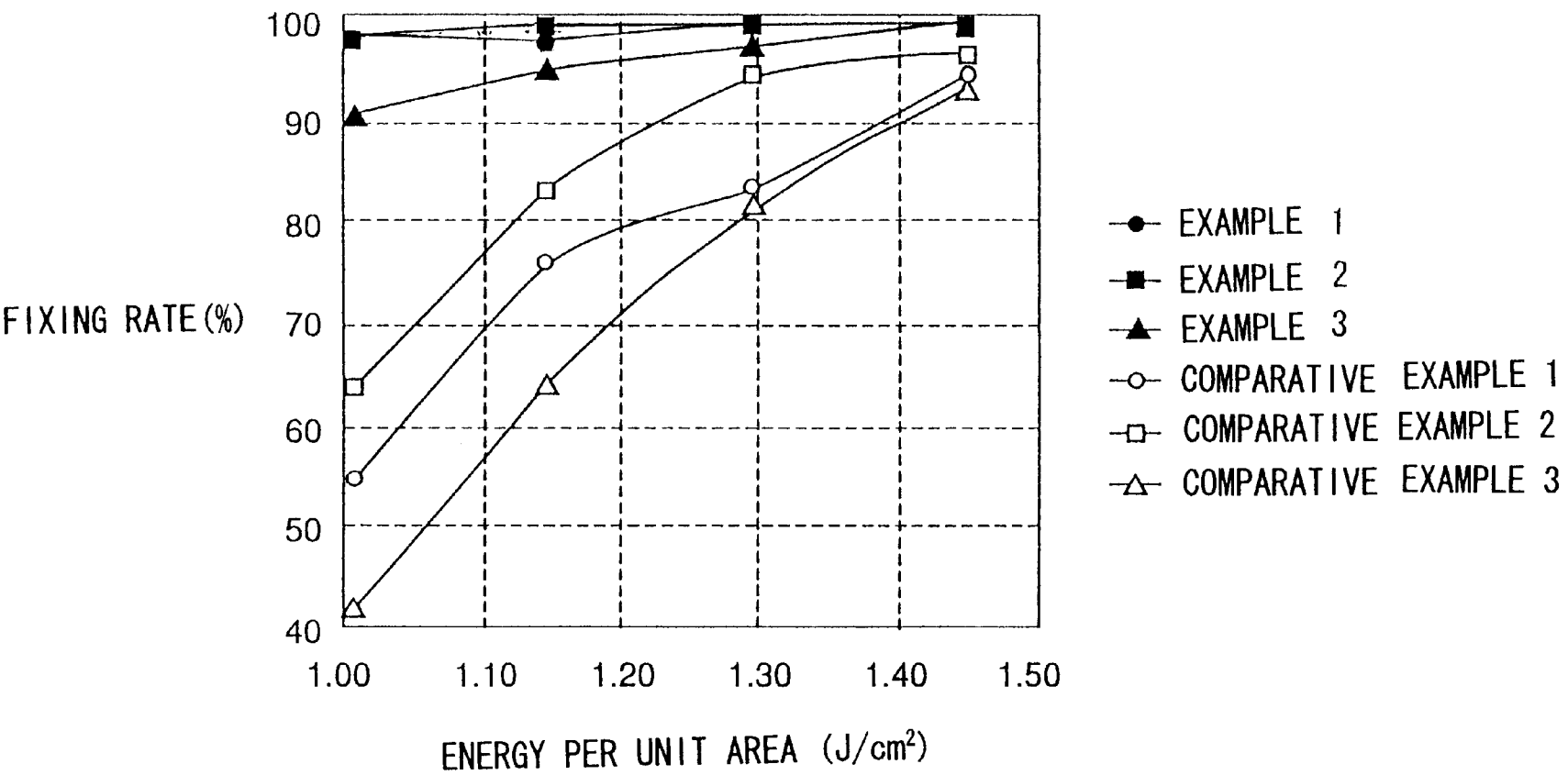
FIG. 2 shows the relationship between light energy per unit area and a fixing rate based on the data shown in FIG. 1.

The results of the evaluation are shown in Table 1 and FIG. 2. Table 1 shows the fixing rates measured for the color toners of Examples 1 to 3 and Comparative Examples 1 to 3 with various light energy amounts per unit area. FIG. 2 shows the relationship between the light energy amount per unit area and the fixing rate based on the data shown in Table 1.

TABLE 1

| | | Light energy (J/cm$^2$) | | | |
|---|---|---|---|---|---|
| | | 1.01 | 1.15 | 1.29 | 1.45 |
| Fixing Rate (%) | Example 1 | 98 | 98 | 99 | 99 |
| | Example 2 | 98 | 99 | 99 | 99 |
| | Example 3 | 91 | 95 | 97 | 99 |
| | Comparative Example 1 | 55 | 76 | 83 | 94 |
| | Comparative Example 2 | 64 | 83 | 94 | 96 |
| | Comparative Example 3 | 42 | 64 | 81 | 93 |

As can be seen from Table 1 and FIG. 2, the color toners of Examples 1 to 3 each have a fixing rate of 90% or higher when the light energy is 1.01 J/cm$^2$ or greater. On the other hand, the color toner of Comparative Example 2 requires light energy of 1.30 J/cm$^2$ or greater to have a fixing rate of 90% or higher, and the color toners of Comparative Examples 1 and 3 each require light energy of 1.45 J/cm$^2$ or greater to have a fixing rate of 90% or higher. The light energy required in Examples 1 and 3 is about 30% less than the light energy required in Comparative Examples 1 and 3. The light energy required in Example 2 is about 20% less than the light energy require in Comparative Example 2.

Judging from the above evaluation results, the color toners of Examples 1 to 3 can be securely fixed onto a recording medium even with a small amount of light energy.

As described so far, the color toner of the present invention containing the auxiliary binder can be fixed onto a recording medium, such as paper or film, by flashlight that requires less light energy than in the prior art. Since the use of the infrared ray absorption agent can be restricted, the hue of a fixed color image is faithful to the original colorant. Thus, a clear image can be obtained.

Although blue toners were prepared in the fixing test in the above examples, it is also possible to perform a reliable fixing process on toners in other colors. The fixing test was performed by a two-component developer technique in the above-described test, but it should be understood that the color toner of the present invention can also be a magnetic or non-magnetic one-component toner.

In the following, a color image forming apparatus of one-component developer type will be described. Four-color toners including yellow, magenta, cyan, and black, are used in this apparatus. Since the other components are conventional, a photosensitive member and a fixing unit will be described below.

Figure 3:
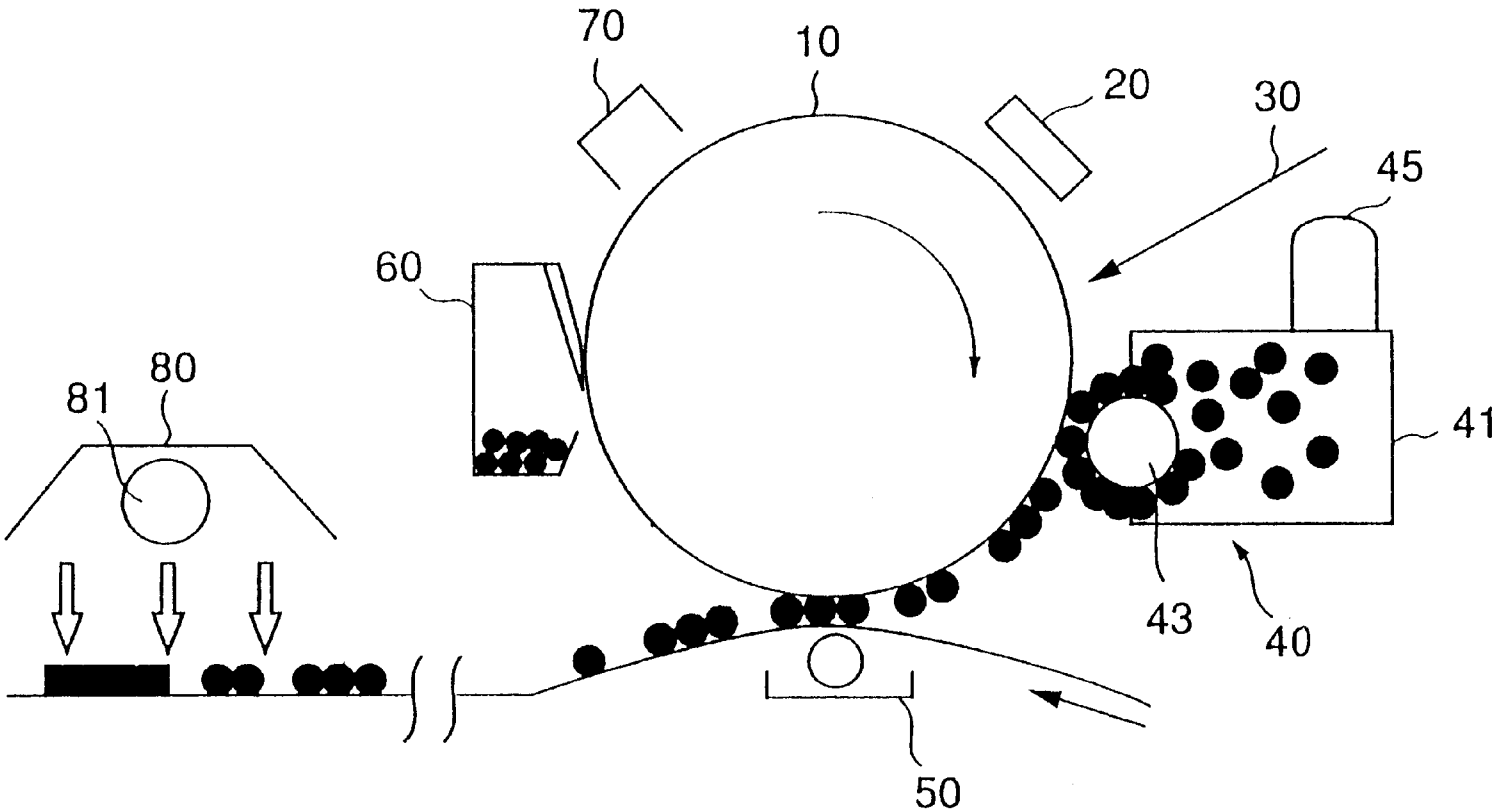
FIG. 3 is a schematic view of an image forming apparatus of one-component developer type in accordance with the present invention.

FIG. 3 is a schematic view of an image forming apparatus of one-component developer type in accordance with the present invention. This apparatus comprises a photosensitive member 10, a charger 20, an exposure unit 30, a developing unit 40, a transfer unit 50, a cleaner 60, a de-electrifier 70, and a flash fixing unit 80 having a xenon flash lamp 81.

The developer unit 40 comprises a developer container 41 and a developing roller 43. The developer container 41 contains a one-component developer made up of a color toner T of the present invention.

With this image forming apparatus, a color toner image can be formed using less light energy from the xenon flash lamp 81, compared with a conventional image forming apparatus of one-component developer type.

The developer unit 40 of the image forming apparatus shown in FIG. 3 has a toner cartridge 45 that stores the color toner of the present invention. The toner cartridge 45 supplies the color toner into the developer container 41, and is attached to the image forming apparatus when an image forming operation is performed. Before being attached to the image forming apparatus, the toner cartridge is kept as a consumable supply.

With the color toner of the present invention, the transportation of a recording medium can be sped up by supplying the same amount of light energy as in the prior art, thereby providing a high-speed image forming apparatus.

The present invention is not limited to the specifically disclosed embodiments, but variations and modifications may be made without departing from the scope of the present invention.

The present application is based on Japanese priority application No. 11-267566, filed on Sep. 21, 1999, the entire contents of which are hereby incorporated by reference.

What is claimed is:

1. A color toner to be fixed onto a recording medium by flashlight, comprising binder resin, infrared ray absorption agent, colorant, and a compound expressed by a formula (1):

(1)

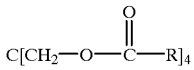

wherein R represents an alkyl group having 4 to 200 carbon atoms.

2. The color toner as claimed in claim 1, wherein the compound expressed by the formula (1) has a melting point of 60° C. to 100° C.

3. The color toner as claimed in claim 1, wherein the infrared ray absorption agent is made of at least one of an aminium compound expressed by a formula (2), a diiminium compound expressed by a formula (3), and a naphthalocyanine compound expressed by a formula (4):

(2)

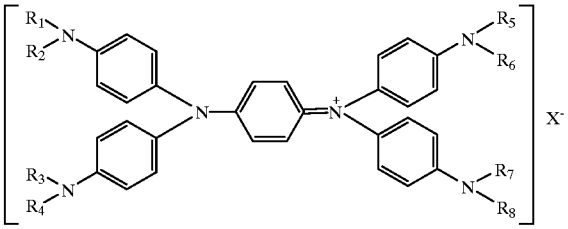

wherein $R_1$ to $R_8$ each represent a hydrogen atom, a halogen atom, an alkyl group, an aryl group, an alkoxyl group, a nitro group, or a carboxyl group, and $X^-$ represents an anion, (3)

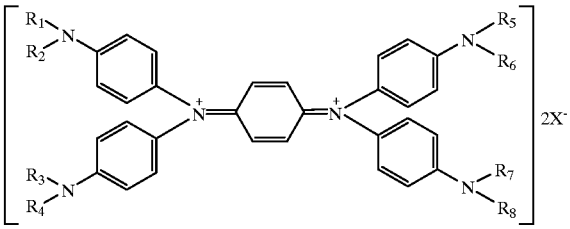

wherein $R_1$ to $R_8$ each represent a hydrogen atom, a halogen atom, an alkyl group, an aryl group, an alkoxyl group, a nitro group, or a carboxyl group, and $X^-$ represents an anion, (4)

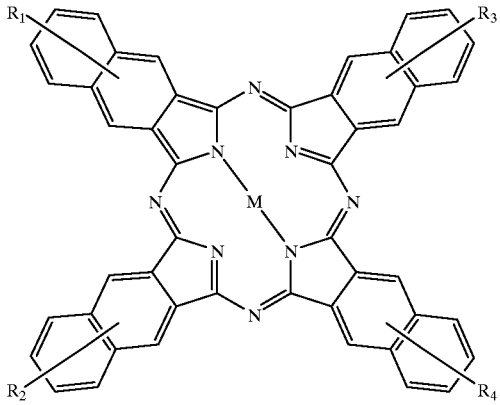

wherein M represents a metal, a metal oxide, or a halogen metal, and $R_1$ to $R_4$ each represent a hydrogen atom, a halogen atom, an alkyl group, an aryl group, an alkoxyl group, a nitro group, or a carboxyl group.

4. An image forming apparatus that fixes a toner image onto a recording medium by flashlight, comprising:

a developer unit having a developer container and a developer roller; and a flash fixing unit having a xenon flash lamp, the developer container containing a color toner that comprises binder resin, infrared ray absorption agent, colorant, and a compound expressed by a formula (1):

(1)

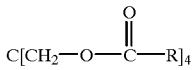

wherein R represents an alkyl group having 4 to 200 carbon atoms.

5. A toner cartridge that is used in an image forming apparatus that fixes a toner image onto a recording medium by flashlight, said toner cartridge contains a color toner that comprises binder resin, infrared ray absorption agent, colorant, and a compound expressed by a formula (1):

(1)

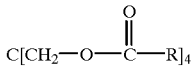

wherein R represents an alkyl group having 4 to 200 carbon atoms.

* * * * *